United States Patent [19]

Carter

[11] 4,109,579

[45] Aug. 29, 1978

[54] PRACTICE AMMUNITION DEVICE

[75] Inventor: Harry R. Carter, Moscow, Pa.

[73] Assignee: Carter Pol Development Corp., Moscow, Pa.

[21] Appl. No.: 737,144

[22] Filed: Oct. 29, 1976

[51] Int. Cl.[2] ..... F42B 13/22

[52] U.S. Cl. ..... 102/41; 102/7.6; 102/49.2

[58] Field of Search ..... 102/41, 49.1, 49.2, 102/92.7, 7.6; 106/99

[56] References Cited

U.S. PATENT DOCUMENTS

| | | | |
|---|---|---|---|
| 1,632,147 | 6/1927 | Ragsdale | 102/7.6 |
| 2,607,294 | 8/1952 | Lindman | 102/7.6 |
| 3,094,934 | 6/1963 | Anthony | 102/41 |
| 3,852,082 | 12/1974 | Majumdar | 106/99 |

FOREIGN PATENT DOCUMENTS

| | | | |
|---|---|---|---|
| 715,314 | 8/1965 | Canada | 102/64 |

*Primary Examiner*—Verlin R. Pendegrass
*Attorney, Agent, or Firm*—David A. Tamburro

[57] ABSTRACT

A practice ammunition device, particularly a practice mortar shell, corresponding substantially identically to a live, tactical mortar shell in size, weight, configuration, and location of center of gravity. The practice shell closely simulates a live shell in all phases of operation including handling, loading, trajectory, and impact.

10 Claims, 4 Drawing Figures

PRACTICE AMMUNITION DEVICE

BACKGROUND OF THE INVENTION

This invention relates generally to practice ammunition for automatic weapons, and more specifically to a practice mortar shell which closely simulates a live, tactical mortar shell in both physical and operational characteristics.

It is common practice to employ practice ammunition devices during military training sessions. For example, typical aerial practice bombs are shown in U.S. Pat. Nos. 1963451 and 2607294. During training sessions with weapons such as an 81 mm mortar, practice devices of the type shown in U.S. Pat. Nos. 2821 923; 3211094; 3374738; and 3948179 have been known and used for some time. This type of device includes an outer dummy cartridge adapted to fit within the barrel of a mortar and a smaller projectile cartridge located within the dummy shell. Only the smaller projectile cartridge is propelled through the air toward a target, and in no way does this cartridge simulates flight characteristics of a normal live mortar shell. Consequently it has been difficult to evaluate the accuracy and effectiveness of a training session. In addition, because of the rather complex construction of this type of practice device, it is quite expensive and thus prohibitive as to the number of practice rounds which may be fired.

OBJECTS AND SUMMARY OF THE INVENTION

Accordingly, the primary object of this invention resides in the provision of a novel practice shell which closely simulates a live, tactical ammunition shell such as an 81 mm mortar shell in both physical and ballistic characteristics so as to enable military personnel to be trained under substantially normal firing conditions.

Another object of the invention resides in the provision of the novel practice shell described above which is much cheaper in cost than known practice devices, thereby affording a substantially greater number of training firing rounds for a given dollar expenditure.

Still another object of the invention resides in the provision of a novel practice shell comprising an inner tube, an outer casing corresponding substantially to the shape of a tactical mortar shell, and a cementitious ballast material set in place between the tube and casing. A nose assembly is fixed to the front end of the tube and casing and houses a firing pin assembly, which upon impact of the nose with a target detonates a signal device slidably mounted within the front end of the tube. The ballast material is of such a mixture to provide an overall weight and location of center of gravity closely simulating those of a live mortar shell.

Other objects and advantages of the invention will become apparent from reading the following detailed description of the invention wherein reference is made to the accompanying drawings in which like numerals indicate like elements.

DETAILED DESCRIPTION OF THE INVENTION

Figure 1:
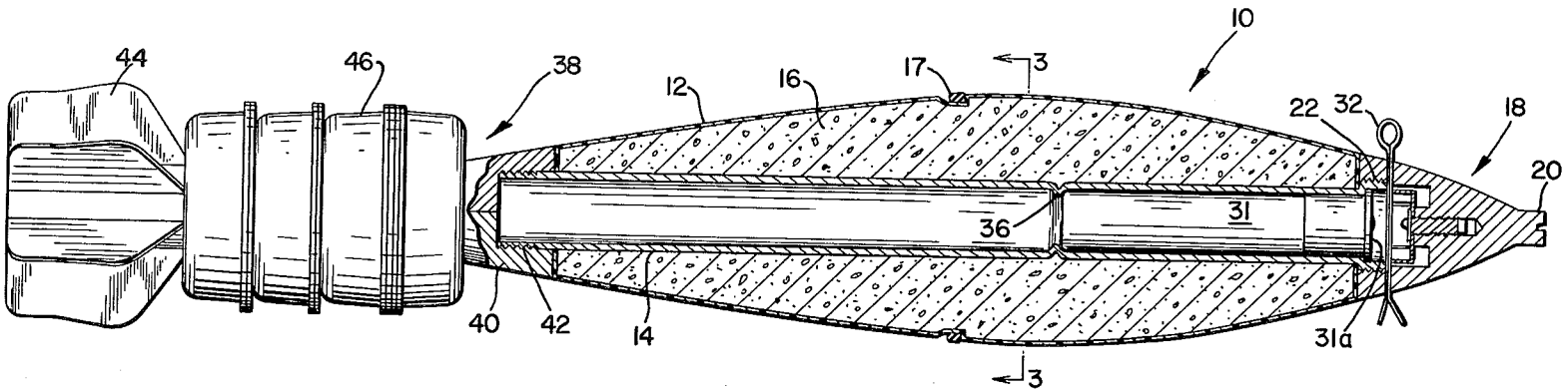
FIG. 1 is a fragmentary sectional view of a practice shell constructed according to the invention.

Referring now to the drawings, the practice shell 10 of the invention comprises a thin, smooth outer casing 12 of plastic or other suitable material corresponding in configuration, shape, and size to a desired tactical ammunition shell such as an 81 mm mortar shell type M374 illustrated in United States Army Field Manual FM 23-90. An inner steel tube 14 is mounted coaxially within and spaced from casing 12 except for its ends which extend through and beyond the ends of casing 12. A cementitious ballast material 16 is molded in place between casing 12 and tube 14 and is of predetermined suitable composition to similate the weight and location of the center of gravity of a tactical shell. An obturator band 17 provides the usual seal between casing 12 and the barrel of the mortar during firing.

Figure 4:
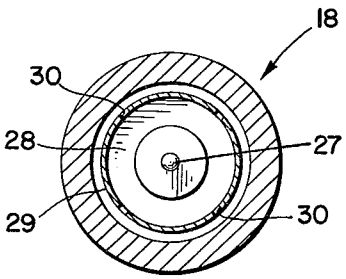
FIG. 4 is a sectional view taken along line 4—4 of FIG. 2 illustrating the crush cup firing pin assembly.
Figure 3:
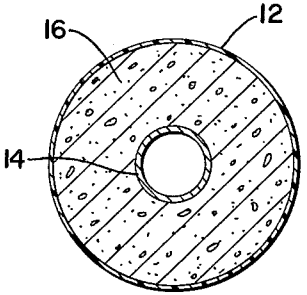
FIG. 3 is a cross sectional view of the practice shell taken generally along line 3—3 of FIG. 1.
Figure 2:
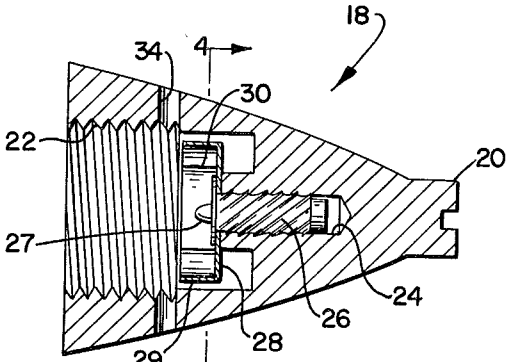
FIG. 2 is an enlarged sectional view of the nose assembly of the practice shell of FIG. 1.

Shell 10 includes at its front end a nose assembly 18 comprised of a tapered cast iron nosepiece 20 threaded at 22 onto the front end of tube 14. Nosepiece 20 has a central, blind drilled hole 24 in which the stem 26 of firing pin 27 of a crush cup firing pin assembly snugly fits to retain pin 27 in place. A crush cup 28 surrounds pin 27 and has a cylindrical flange 29 which extends beyond the end of pin 27. As shown best in FIGS. 2 and 4 flange 29 is provided with a plurality of axially extending slots 30. A 10 guage signal cartridge 31 is positioned within the front end of tube 14 in normal spaced relationship from pin 27 and is preferably of a type which, upon detonation, gives a smoke, report, and flash signal. A removable safety pin 32 extends through a transverse hole 34 in nosepiece 20 to normally prevent cartridge 30 from moving forward and striking pin 28. The described firing pin assembly provides a double safety fusing feature. The primary safety is of course pin 32. However, when this pin is removed, a secondary safety is provided by the slotted flange 29 of cup 28. The diameter of flange 29 is smaller than the outer diameter of the head 31a of cartridge 31 so that flange 29 normally prevents the cartridge from striking firing pin 29. Cartridge 31 must engage flange 29 with a predetermined force before it will sufficiently crush the flange to enable it to strike pin 27. In a prototype of shell 10, it was necessary to drop the shell 13 feet before cartridge 31 attained a sufficient inertial force to crush flange 29. This secondary safety fusing feature enables shell 10 to be handled, transported, loaded, etc. without accidental detonation of cartridge 31.

The rear end of cartridge 31 engages against a support shoulder 36 in tube 14 provided by a slight crimped section as shown in FIG. 1, or by a counterbore in the front end of the tube, or by a separate smaller tube housed within tube 14. Shoulder 36 prevents cartridge 31 from sliding rearwardly within tube 14 under inertial forces.

A conventional tailpiece assembly 38 forms the rear end of shell 10 and includes a tubular body section 40 threaded at 42 onto the rear end of tube 14. Assembly 38 includes the usual rear fin assembly 44 and multiple charge propelling unit 46 which function in the usual manner to propel and guide shell 10. As with a tactical mortar shell, the number of propellant bags in unit 46 determine the range of shell 10, e.g. four bags provide a range of about 4000 meters. Threaded section 42 forms a frangible connection between tailpiece section 40 and tube 14, with the number of threads determining the breaking point of the connection.

The cementitious ballast material 16 is of a specific composition so that, when mixed with water, it sets up rapidly between casing 12 and tube 14, it develops high early strength so that casing 12 may be handled shortly after the mixture is poured within, and it expands upon setting to completely fill the space between casing 12 and tube 14. Material 16 preferably is comprised of a gypsum cement binder manufactured and sold by United States Gypsum Company under the name Duracel cement, iron grit or fines passing a No. 40 screen size, and reinforcing glass fiber strands of ½ in. maximum length. In molding material 16 within a casing 12 conforming to a tactical shell type M374 approximately 2.8 lbs. of Duracel cement is mixed with approximately 3.2 lbs. iron grit, approximately 12 grams glass fiber strands, and approximately 3.5 lbs. cold water. Expressed in percentages by weight, this mixture consists of 29.39% cement, 33.59% iron, 0.28% fibers, and 36.74% water. The mixture sets very rapidly within the casing to greatly simplify and expedite production and handling operations. When fully set, the mixture affords practice shell 10 a weight and center of gravity location substantially identical to a tactical mortar shell, with any deviations being within acceptable military standards.

During a practice exercise, shell 10 is handled like and functions substantially identically to a tactical shell. Safety pin 32 is removed and shell 10 is dropped into a mortar barrel. In standard fashion propellant unit 46 is ignited and shell 12 is propelled the normal proscribed distance, depending upon the number of propellant bags. During ignition and flight, cartridge 31 is supported by shoulder 36. Upon impact of nose 20 with the ground or other target, cartridge 30 slides forward crushing flange 29 and striking pin 27. The cartridge is exploded and the force of the explosion causes the threaded connection 42 to sever and tailpiece 40 to blow off the end of tube 14. Smoke, report, and flash signals are emitted to indicate the location of the hit.

It is understood of course that while the description of the invention presented hereinabove relates primarily to a practice shell simulating an 81 mm mortar shell, the invention itself is not so limited but may be applied generally to other type projectiles.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A practice shell comprising an outer casing; tubular means mounted coaxially within and spaced from said casing substantially throughout its length; cementitious ballast means substantially filling the space between said casing and tubular means, said cementitious ballast means being of suitable composition so that, when mixed with water, it sets up rapidly between said casing and tubular means, it develops high early strength, and it expands upon setting to substantially completely fill the space between said casing and tubular means; a nose assembly connected to the forward end of said tubular means; a firing pin assembly mounted within said nose assembly; and a signal device mounted within said tubular means and adapted to be detonated by said firing pin assembly upon impact of said nose assembly with a target.

2. The practice shell defined in claim 1, said cementitious ballast means comprising gypsum cement, iron grit, and glass fiber strands.

3. The practice shell defined in claim 2, wherein said cementitious ballast means as mixed with water comprises approximately 29% gypsum cement, approximately 34% iron grit, approximately 0.3% glass fiber strands, and approximately 36.7% water.

4. The practice shell defined in claim 1, said tubular means including shoulder means adapted to support said signal device within the front end of said tubular means.

5. The practice shell defined in claim 1 comprising a tailpiece assembly, frangible means connecting said tailpiece assembly to the rear end of said tubular means and adapted to release said tailpiece assembly iron said tubular means upon detonation of said signal device.

6. The practice shell defined in claim 5, wherein said tailpiece assembly includes charge propellant means and a rear fin assembly for propelling and guiding a shell in use.

7. The practice shell defined in claim 1, said firing pin assembly comprising a firing pin fixed within said nose assembly, a removable safety pin normally preventing said signal device from striking said firing pin, crushable cup means surrounding said firing pin and normally preventing said signal device from engaging said firing pin until said cup means is struck by said signal device with a predetermined force, whereby accidental detonation of said signal device is prevented.

8. The practice shell defined in claim 7, said crushable cup means comprising a cylindrical flange surrounding said firing pin and a plurality of axially extending slots in said flange.

9. A practice mortar shell comprising an outer casing, tubular means mounted coaxially within and spaced from said casing, said tubular means having forward and rearward ends extending beyond the ends of said casing; cementitious ballast means substantially filling the space between said casing and said tubular means, a nose assembly threadedly connected to the forward end of said tubular means, a firing pin assembly housed within said nose assembly, a signal device mounted within said tubular means and adapted to be detonated by said firing pin assembly upon impact of said nose assembly with a target, a tailpiece assembly, frangible thread means connecting said tailpiece assembly to said rearward end of said tubular means and adapted to release said tailpiece assembly from said tubular means upon detonation of said signal device, said tailpiece assembly including charge propellant means and a rear fin assembly for propelling and guiding a shell in use.

10. The practice shell of claim 9, wherein said cementitious ballast means is of suitable composition so that, when mixed with water, it sets up rapidly between said casing and tubular means, it develops high early strength, and it expands upon setting to substantially completely fill the space between said casing and tubular means.

* * * * *